US007014079B2

(12) United States Patent
Swann

(10) Patent No.: US 7,014,079 B2
(45) Date of Patent: Mar. 21, 2006

(54) CAULKING TUBE REPLACEMENT TIP

(75) Inventor: Jeffrey J. Swann, 4006 E. Blvd. #6., Los Angeles, CA (US) 90066

(73) Assignee: Jeffrey J. Swann, Los Angeles, CA (US)

( * ) Notice: Subject to any disclaimer, the term of this patent is extended or adjusted under 35 U.S.C. 154(b) by 85 days.

(21) Appl. No.: 10/745,847

(22) Filed: Dec. 23, 2003

(65) Prior Publication Data

US 2005/0133547 A1 Jun. 23, 2005

(51) Int. Cl.
*B65D 25/04* (2006.01)

(52) U.S. Cl. ..... 222/570; 222/326

(58) Field of Classification Search ..... 222/567, 222/570, 326, 327, 573
See application file for complete search history.

(56) References Cited

U.S. PATENT DOCUMENTS

| | | | | |
|---|---|---|---|---|
| 209,871 | A | | 11/1878 | Dillon et al. |
| 260,614 | A | | 7/1882 | Schmitz |
| 277,827 | A | | 5/1883 | Bailey |
| 282,800 | A | | 8/1883 | Taylor |
| 283,800 | A | | 8/1883 | Mayo |
| 412,117 | A | | 10/1889 | Poire |
| 2,365,524 | A | | 12/1944 | Court |
| 2,754,033 | A | | 7/1956 | Etter |
| 2,788,159 | A | | 4/1957 | Crewe |
| 2,821,332 | A | * | 1/1958 | Sherbondy ..... 222/569 |
| 2,953,285 | A | | 9/1960 | McKelvey |
| 3,058,632 | A | | 10/1962 | Stremmel |
| 3,093,274 | A | | 6/1963 | Galblerz |
| 3,822,812 | A | * | 7/1974 | Shorin et al. ..... 222/570 |
| 3,886,711 | A | | 6/1975 | Brothers et al. |
| 4,258,884 | A | | 3/1981 | Rogers |
| 4,382,530 | A | | 5/1983 | Calisto |
| 4,957,225 | A | | 9/1990 | Childers |
| 5,017,113 | A | | 5/1991 | Heaton et al. |
| 5,104,013 | A | | 4/1992 | Hawley |
| 5,137,184 | A | | 8/1992 | Jackson et al. |
| 5,249,716 | A | | 10/1993 | O'Sullivan |
| 5,249,876 | A | | 10/1993 | Hattman |
| 5,894,956 | A | | 4/1999 | Keith |
| 6,022,504 | A | | 2/2000 | Boaz et al. |
| 6,076,712 | A | | 6/2000 | Esber et al. |

FOREIGN PATENT DOCUMENTS

| | | |
|---|---|---|
| CA | 1238023 | 6/1988 |
| WO | WO 81/00127 | 1/1982 |

* cited by examiner

*Primary Examiner*—Michael Mar
*Assistant Examiner*—Melvin A Cartagena
(74) *Attorney, Agent, or Firm*—Shimokaji & Associates P.C.

(57) ABSTRACT

A universal replacement tip for a caulking tube designed to replace an original caulking tube tip after the tip has been used or in the event the user wishes to use a tip that produces a different shape and/or thickness of caulking bead without the need or special adapters, flanges or modification to the dispensing gun in which the caulking tube is used. The caulking tube replacement tip includes a flange at its base with an adhesive material attached to the bottom of the flange. The base is placed over the remains of the original caulking tube tip after it has been cut off and is secured to the top of the caulking tube with the adhesive material. The caulking tube replacement tip tapers up from the base to a sealed tip which can be any shape and size including round, oval, rectangular, square and star-shaped.

16 Claims, 3 Drawing Sheets

CAULKING TUBE REPLACEMENT TIP

BACKGROUND OF THE INVENTION

The present invention generally relates to a caulking tube tip, and more particularly to a replacement tip for a caulking tube and methods of using caulking tube replacement tips.

A caulking tube comprises a cylindrical container filled with caulking compound. It generally has a stationery or fixed forward end with an affixed hollow plastic dispensing tip and a movable rear wall which translates within the tube. The forward wall has an orifice or perforation through which the contained material is expelled when a compressive force is exerted against the moveable rearwall. If the entire tube of caulking compound is not used in the initial application, storing the remaining compound in the tube while waiting the next use has been a problem. Even if the open end of the tip is sealed with a cap, or similar appliance, the material in the tip during storage has a tendency to dry out and lodge within the interior of the tip. Removing the dried material is difficult and, often times, the use of the remaining material within the tube is impossible resulting in waste and expense.

Heretofore, systems have been devised for providing replaceable tips for caulking tubes, but each has one or more significant drawbacks. Each requires that the caulking tube, at the time of initial manufacture, have a provision for the fitting of an original or replacement tip and the replacement tips are made to fit the particular cartridge. They generally involve a tapered nozzle on the end of the caulking tube designed to mate with a special flange built into the end of the caulking gun which flange is designed to accept a specifically-manufactured nozzle as in U.S. Pat. No. 4,382,530 to Calisto. Or, they involve a threaded nozzle designed to accept a specifically-manufactured replacement tip having an internal thread designed for replacement engagement on the nozzle as in U.S. Pat. No. 4,957,225 to Childers. Such systems provide a specific replacement nozzle for use with a specifically-manufactured caulking tube. They do not provide a universal replacement tip which can be used with any caulking tube.

SUMMARY OF THE INVENTION

In one aspect of the present invention, a caulking tube replacement tip for replacing the original tube tip on a caulking tube comprises a cylindrical hollow tube of plastic-like material, a circular flange attached to one end of the hollow tube with adhesive material on the base of the flange, and a hollow tapered top section terminating in a sealed tip.

In another aspect of the present invention, the caulking tube replacement tip comprises a hollow conical section terminating in a sealed tip. A circular flange is attached to the base of the conical section. Adhesive material is on the bottom of the flange.

Another aspect of the present invention is a method for using a caulking tube replacement tip to replace an original caulking tube tip on a disposable cartridge for a dispensing gun comprises cutting off the original caulking tip on the disposable cartridge, preparing the adhesive material on the base of caulking tube flange, placing the caulking tube replacement tip over the remains of the original caulking tip and securing the adhesive material on the base of the flange to the end of the disposable cartridge.

DETAILED DESCRIPTION OF THE INVENTION

An apparatus and method is provided by the present invention that allows the replacement of the original caulking tube tip on a disposable caulking cartridge for a dispensing-type gun. The invention can be used to quickly and economically replace the original caulking tube tip of any standard caulking tube cartridge without the need for any special or unique adapters for either the caulking tube cartridge or for the dispensing gun in which the cartridge is used.

Figure 1:
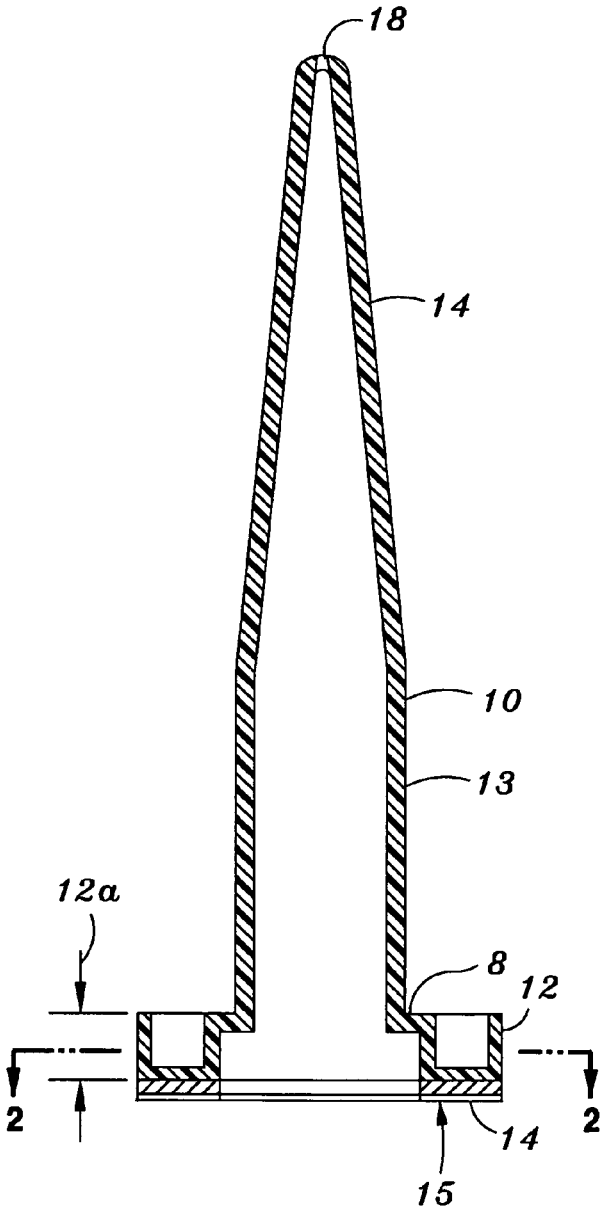
FIG. 1 is a cross sectional view through a replacement tip embodying the invention.

The caulking tube replacement tip invention comprises a hollow cone of plastic-type material 10 with a flange 12 at its base 8 as in FIG. 1, a sectional view of a replacement tip. As shown, the replacement tip comprises a flange at the base 8, a hollow cylindrical section 13, and a hollow tapered section 14 terminating in a sealed tip 18. The flange 12 has an adhesive material 14 applied to its outer side with a peel-away membrane covering 15. For the caulking tube replacement tip to function properly, it is important that the thickness 12*a* of the flange be greater than 0.10 inches and no more than 0.40 inches, ideally in the range of 0.20 to 0.32 inches. Typically the flange will be approximately 0.32 inches thick. If the flange is too thick, it will not fit inside most caulking dispensing guns. If the flange is too thin, the flange of the caulking tube replacement tip will prevent a proper seal from being created. It is also important that the outer diameter 12*b* of the flange be greater than 0.75 inches and that it be no larger than 1.60 inches, ideally in the range of 0.809 to 1.38 inches. Typically, the flange diameter is approximately 1.3 inches. If the outer diameter is too great, the flange will contact the irregular surfaces on the caulking tube end and will not allow a proper seal. If the outer diameter is too small, it will not provide enough surface area for the adhesive gasket.

The caulking tube replacement tip may be made in any practical length depending on its application. A typical caulking tube replacement tip length is approximately 3.87 inches.

Figure 2A:
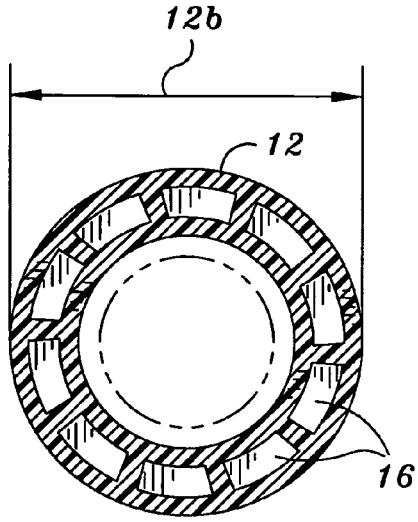
FIG. 2A is a view in detail of the portion of the flange at the base of the tip indicated by section lines 2—2 in FIG. 1 showing a pocket design.
Figure 2B:
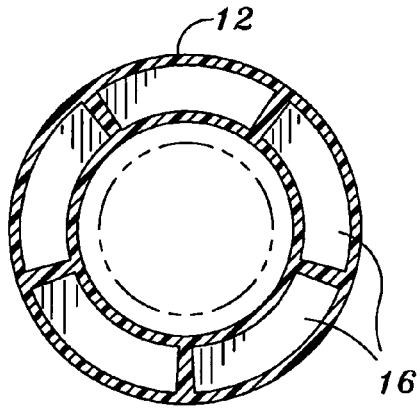
FIG. 2B is a view in detail of the flange at the base of the replacement tip indicated by section lines 2—2 in FIG. 1 showing an alternative pocket design.
Figure 3A:
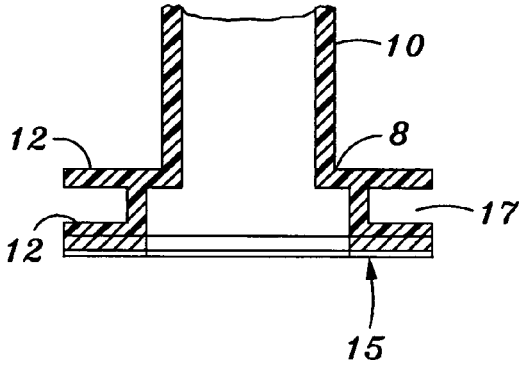
FIG. 3A is a cross sectional view through the flange at the base of the replacement tip showing an alternative flange design, a spool-shaped pocket around the perimeter of the flange.
Figure 3B:
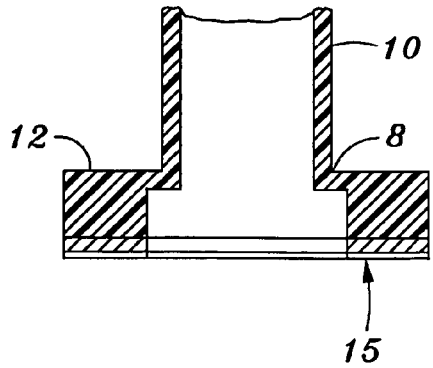
FIG. 3B is a cross sectional view through the flange at the base of the replacement tip showing alternatively a solid flange with no pockets.
Figure 3C:
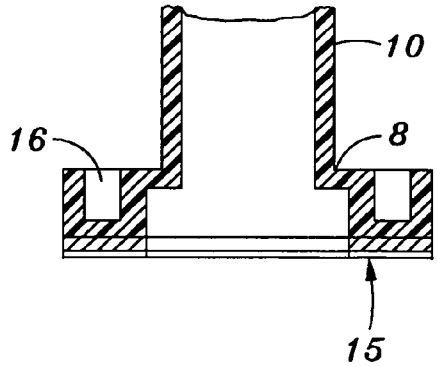
FIG. 3C is a cross sectional view through the flange at the base of the replacement tip showing an alternative flange design of circular pockets on the upper side of the flange.
Figure 3D:
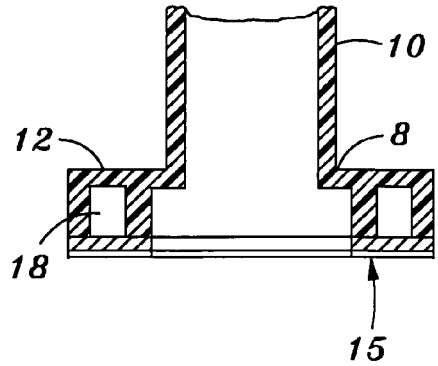
FIG. 3D is a cross sectional view through the flange at the base of the replacement tip showing an alternative flange design of circular pockets on the lower side of the flange.

To minimize the use of plastic and reduce manufacturing costs of the caulking tube replacement tip, and to minimize plastic shrinkage, the flange 12 of the caulking tube replacement tip may be manufactured to contain pockets or cavities 16 void of plastic. FIG. 2A is a sectional view through flange 12 and shows typical pockets or cavities molded into the flange during manufacture. The pockets may be open at either the top or the bottom of the flange 12 but do not extend all the way through the flange. The pockets can be of any shape—rectangular, circular or otherwise. The flange 12 may also be molded with a spool-shaped pocket 17 running around the entire perimeter of the exterior wall of the flange as shown in FIG. 3B.

Figure 4:
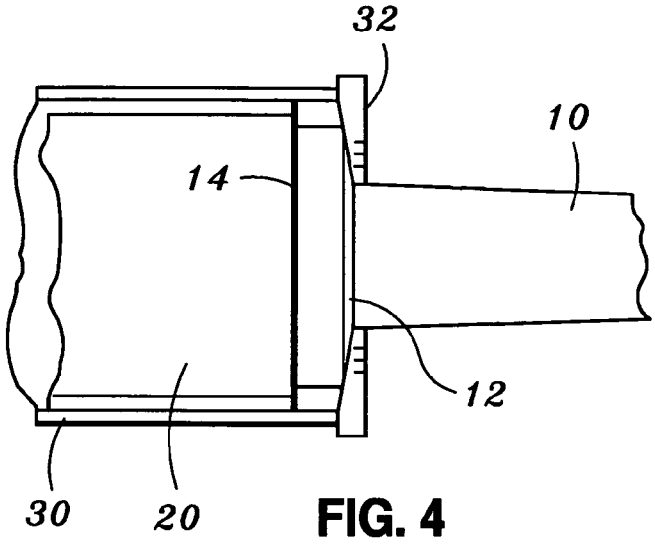
FIG. 4 is a cross sectional view of the end of a caulking gun showing the replacement tip of the invention mounted on the end of a disposable caulking tube mounted in a dispensing gun.
Figure 5:
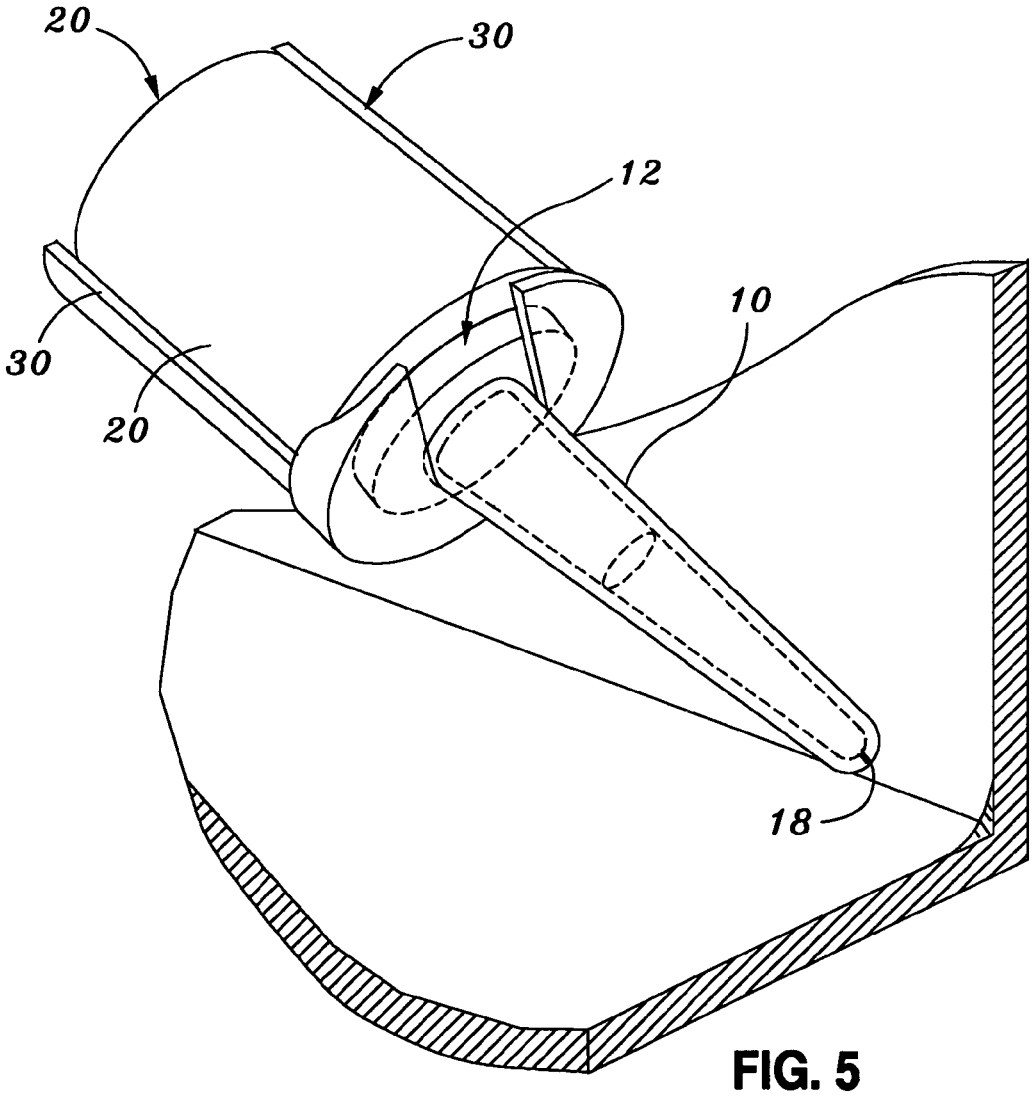
FIG. 5 is a perspective view of the invention showing the use of the replacement tip installed on a caulking tube which has been installed in a dispensing gun.

The use and operation of the caulking tube replacement tip is simple and straightforward. After the caulking tube has been used, the user cuts off the original caulking tip on the disposable caulking tube 20 with a knife as close to the caulking tube as possible. Then the protective membrane 15 is peeled away from the adhesive backing 14 of the caulking tube replacement tip, the caulking tube replacement tip is placed over the remains of the original caulking tip and the adhesive material 14 at the base of the flange is affixed to the end of the disposable caulking tube. Then, the caulking tube cartridge 20 is placed into the caulking tube gun 30 as depicted in FIG. 3 with the caulking tube replacement tip protruding through the front of the gun 32. The adhesive membrane 14 acts as a gasket to prevent the caulking from leaking between the flange and the caulking tube end. Pressure from the caulking tube gun piston further compresses the caulking tube replacement tip adhesive membrane, further sealing the replacement tip to the disposable caulking tube. After installation, the sealed tip allows the caulking tube replacement tip to function as an airtight cap and sealer to prevent the caulking material from hardening inside the caulking tube during storage. Before use, the sealed tip end is cut off, typically with a knife. A typical use of a caulking tube replacement tip 10, when placed on a caulking tube 20, installed in a caulking tube gun is shown in FIG. 4.

Alternative embodiments of the invention may include a caulking tube tip which is angled away from the flange to allow for applications in tight spots. The length of the tip may be varied from short to very long to allow application of material into locations which would be otherwise inaccessible. The adhesive material 14 on the base of the flange can, instead, be a sticky rubber substance or any similar gasket-type material. The diameter of the tip end of the caulking tube replacement tip may be varied for the application of materials of different widths. The shape of the tip end may be varied to be of any conceivable configuration including circular, oval, rectangular, squared, star-shaped. The tip portion 18 may be supplied with a cap for securing it after it has been opened.

Although the present invention describes a caulking tube replacement tip, it should be realized that the invention can be used for any material dispensed from a disposable cartridge used in a gun-type dispenser.

While the above description contains many specificities, these should not be construed as limitations on the scope of the invention, but as examples of the presently-preferred embodiments thereof. Many other ramifications and variations are possible within the teachings of the invention. Thus, the scope of the invention should be determined by the appended claims and their legal equivalence and not by the examples given.

We claim:

1. A caulking tube replacement tip for a disposable cartridge for a dispensing-type gun comprising:

a hollow tube consisting of a top section and a bottom section;

a flange attached to the bottom of said tube consisting of a top surface, a bottom surface, and a perimeter surface wherein said flange contains one or more pockets in one of said top surface thereof and said bottom surface thereof;

an adhesive material attached to the bottom surface of said flange;

a hollow top section terminating in a tip attached to the top of said hollow tube.

2. The caulking tube replacement tip of claim 1 wherein said top section has a circular cross section in at least one location along its length.

3. The caulking tube replacement tip of claim 1 wherein said top section has a rectangular cross section in at least one location along its length.

4. The caulking tube replacement tip of claim 1 wherein said top section has an oval cross section in at least one location along its length.

5. The caulking tube replacement tip of claim 1 wherein said top section has a star shaped cross section in at least one location along its length.

6. The caulking tube replacement tip of claim 1 wherein said flange contains a spool-shaped pocket around the perimeter of said flange.

7. The caulking tube replacement tip of claim 1 wherein the thickness of said flange is in the range of 0.10 to 0.40 inches.

8. The caulking tube replacement tip of claim 1 wherein the diameter of said flange is in the range of 0.75 to 1.6 inches.

9. The caulking tube replacement tip of claim 1 wherein said adhesive material has a removable, protective membrane applied to the face thereof.

10. The caulking tube replacement tip of claim 1 wherein said adhesive material is a sticky, rubbery substance.

11. The caulking tube replacement tip of claim 1 wherein said adhesive material is a sticky, resilient gasket.

12. The caulking tube replacement tip of claim 1 where said flange has a groove in its perimeter surface.

13. A method of using a caulking tube replacement tip for a disposable cartridge for a dispensing-type gun, which comprises a hollow tube consisting of a top section an a bottom section; a flange attached to the bottom of said tube consisting of top surface, a bottom surface, and a perimeter surface; an adhensive material attached to the bottom surface of said flange; and a hollow top section terminating in a tip attached to the top of said hollow tube, to replace an original caulking tip on a disposable cartridge for a dispensing-type gun consisting of the following steps:

cutting off the original caulking tip on the disposable cartridge;

placing the caulking tube replacement tip over the remains of the original caulking tip; and securing the adhesive material on the bottom of the flange of the caulking tube replacement tip to the end of the disposable cartridge.

14. The method of claim 13, wherein the flange contains pockets or cavities.

15. The method of claim 13, wherein the thickness of the flange attached to the bottom of said tube is in the range of 0.10 to 0.40 inches.

16. The method of claim 13, wherein the original caulking tip on the disposable cartridge is cut completely off.

* * * * *